US007778429B2

(12) United States Patent
Yoshino

(10) Patent No.: US 7,778,429 B2
(45) Date of Patent: Aug. 17, 2010

(54) AUDIO PROCESSOR, AUDIO PROCESSING METHOD, COMPUTER PROGRAM, AND COMPUTER READABLE STORAGE MEDIUM

(75) Inventor: Hiroaki Yoshino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1291 days.

(21) Appl. No.: 10/651,735

(22) Filed: Aug. 29, 2003

(65) Prior Publication Data

US 2004/0044428 A1 Mar. 4, 2004

(30) Foreign Application Priority Data

Aug. 29, 2002 (JP) ..... 2002-251709

(51) Int. Cl.
*G09F 27/00* (2006.01)

(52) U.S. Cl. ..... 381/124; 700/94; 348/207.99; 348/231.4; 348/231.5

(58) Field of Classification Search ..... 381/111, 381/58, 56, 61, 124; 700/94; 348/231.4–231.5, 348/207, 11, 220.1, 207.99, 333.02, 333.01, 348/333.04, 207.11, 211.4, 99, 211.6; 396/312, 396/287, 311

See application file for complete search history.

(56) References Cited

U.S. PATENT DOCUMENTS 4,746,993 A * 5/1988 Tada ..... 386/107
5,214,516 A * 5/1993 Okino et al. ..... 386/106
5,489,955 A * 2/1996 Satoh et al. ..... 396/312
5,552,850 A * 9/1996 Matsumoto ..... 396/544
5,784,525 A * 7/1998 Bell ..... 386/107
5,822,621 A * 10/1998 Szajewski ..... 396/6
6,018,504 A * 1/2000 Sakamoto et al. ..... 369/7
6,614,986 B2 * 9/2003 Tognazzini ..... 386/46
6,779,196 B1 * 8/2004 Igbinadolor ..... 725/75
2001/0016815 A1 * 8/2001 Takahashi et al. ..... 704/235

(Continued)

FOREIGN PATENT DOCUMENTS

CN 1269659 A 10/2000

(Continued)

OTHER PUBLICATIONS

English Translation of Japanese Utility Model Publication No. 3051537, published Jun. 10, 1998 (the Japanese Patent was submitted in a prior Information Disclosure Statement dated May 13, 2008).

*Primary Examiner*—Vivian Chin
*Assistant Examiner*—Disler Paul
(74) *Attorney, Agent, or Firm*—Cowan, Liebowitz & Latman, P.C.

(57) ABSTRACT

This invention has as its object to record audio data by a simple operation upon recording the audio data as an operation sound or startup sound of an image sensing apparatus such as a digital camera or the like. To this end, upon recording audio data, since a startup sound, operation sound, shutter sound, and self-timer sound are set as purposes of audio data to be recorded, an audio recording time is set by selecting a desired one of these purposes. After the audio recording time is set, when audio recording is started by a user's intention, audio recording is executed for the set time, and other operations such as an audio recording stop operation and the like are inhibited during this interval. Hence, audio recording is executed until the set audio recording time elapses.

6 Claims, 6 Drawing Sheets

U.S. PATENT DOCUMENTS

| | | | | |
|---|---|---|---|---|
| 2002/0016644 | A1* | 2/2002 | Yamada | 700/94 |
| 2002/0057351 | A1* | 5/2002 | Suzuki et al. | 348/232 |
| 2002/0057353 | A1* | 5/2002 | Kitsugi et al. | 348/232 |
| 2003/0081934 | A1* | 5/2003 | Kirmuss | 386/46 |
| 2003/0142216 | A1* | 7/2003 | Jelinek | 348/207.99 |

FOREIGN PATENT DOCUMENTS

| | | |
|---|---|---|
| JP | U 3051537 | 6/1998 |
| JP | 11-153818 | 6/1999 |
| JP | 2000-307902 | 11/2000 |
| JP | 2001-142131 | 5/2001 |

* cited by examiner

AUDIO PROCESSOR, AUDIO PROCESSING METHOD, COMPUTER PROGRAM, AND COMPUTER READABLE STORAGE MEDIUM

FIELD OF THE INVENTION

The present invention relates to an audio processor which is used in, e.g., an image sensing apparatus for sensing, recording, and reproducing a moving image, an audio processing method, a computer program, and a computer readable storage medium.

BACKGROUND OF THE INVENTION

Digital cameras, which record and reproduce still images and moving images using a memory card having a solid-state memory element as a recording medium, are already commercially available, and digital cameras having electronic viewfinders such as color liquid crystal panels and the like are also commercially available. With these digital cameras, a digital camera user can determine a composition by continuously displaying an image before image sensing, and can confirm a sensed image by reproducing and displaying it. Especially, a function of reproducing a sensed image immediately after image sensing is convenient, and is useful for digital camera users.

Also, digital cameras having a function of sensing not only a still image but also a moving image are increasing, and the moving image recording time, image size, and the like are improving. Some of such digital cameras are equipped with a microphone and loudspeaker, and have an audio recording/reproduction function using these microphone and loudspeaker and also an after-recording or voice memo function.

On the other hand, some models of digital cameras produce various effect sounds as their startup sound and operation sound in addition to an electronic sound. In these models, when the shutter is released by a self timer, effect sounds such as "Say Cheese", "Click sound", and the like can be used upon image sensing.

Using the functions of the microphone and loudspeaker of a digital camera, recorded audio data can be used as the startup sound and operation sound of the digital camera. However, since the reproduction time is very short, it is difficult to satisfactory record such data. The recorded audio data may be extracted and used by, e.g., an after-recording process. However, in such case, complex operations are required, and the user cannot easily use the function.

SUMMARY OF THE INVENTION

The present invention has been made in consideration of the above situation, and has as its object to record audio data by a simple operation upon recording the audio data as an operation sound or startup sound of an image sensing apparatus such as a digital camera or the like.

In order to solve the above problems, and to achieve the above object, according to the first aspect of the present invention, an audio processor comprises an audio recording time setting device adapted to set an audio recording time, an audio recording start reception device adapted to receive an audio recording start instruction, and an audio recording device adapted to execute audio recording until the set audio recording time elapses, upon reception of the audio recording start instruction.

According to the second aspect of the present invention, an audio processing method comprises an audio recording time setting step of setting an audio recording time, an audio recording start reception step of receiving an audio recording start instruction, and an audio recording step of executing audio recording until the set audio recording time elapses, upon reception of the audio recording start instruction.

According to the third aspect of the present invention, a computer program makes a computer execute an audio recording time setting process for setting an audio recording time, an audio recording start reception process for receiving an audio recording start instruction, and an audio recording process for executing audio r cording until the set audio recording time elapses, upon reception of the audio recording start instruction.

According to the fourth aspect of the present invention, a computer readable storage medium stores the above computer program.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

An embodiment of an audio processor, audio processing method, computer program, and computer readable storage medium according to the present invention will be described hereinafter with reference to the accompanying drawings.

Figure 1:
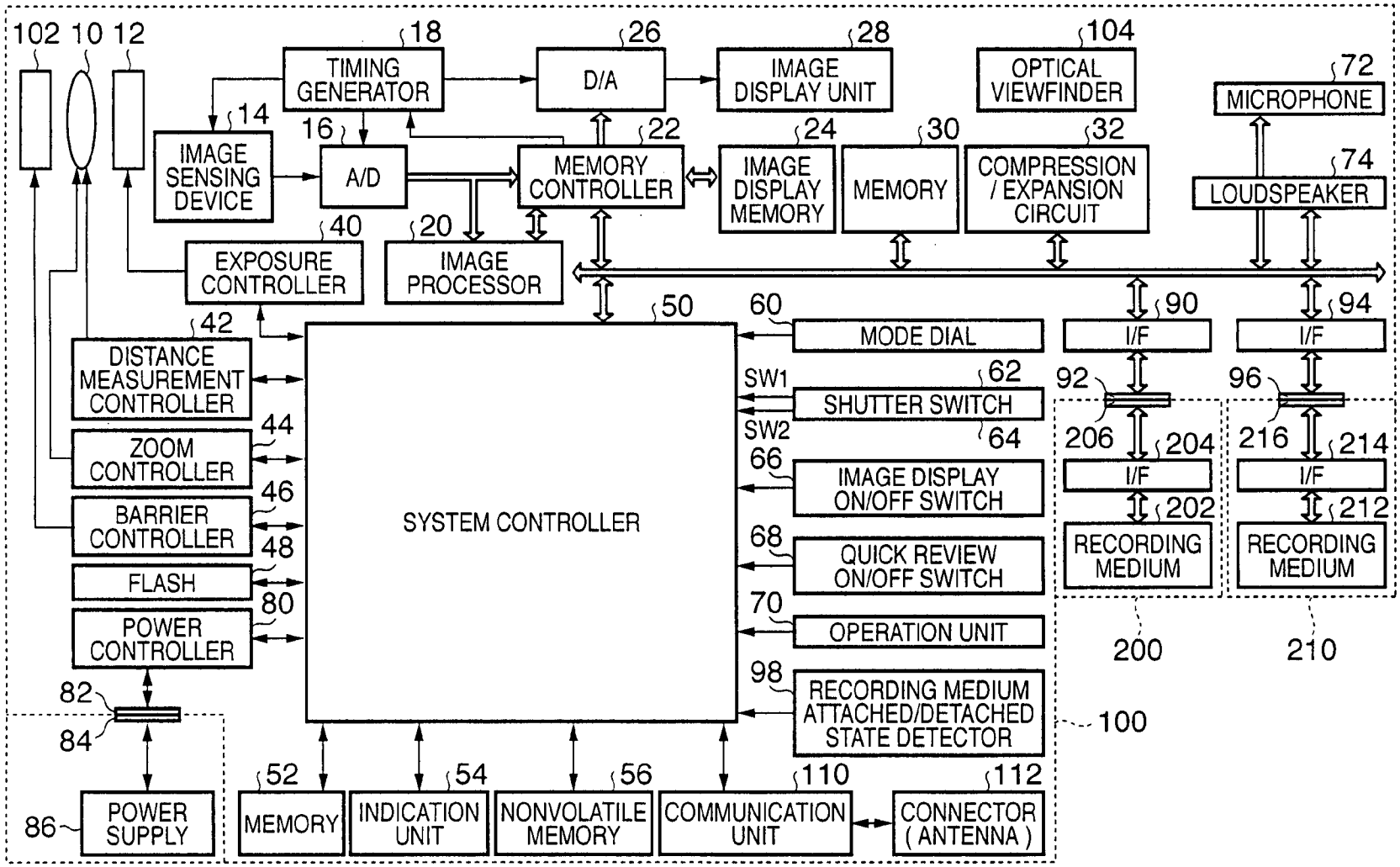
FIG. 1 is a block diagram showing the arrangement of an image sensing apparatus such as a digital camera or the like, which includes an audio processor according to an embodiment of the present invention.

FIG. 1 shows the arrangement of an image sensing apparatus 100 such as a digital camera or the like, which includes an audio processor of this embodiment. Referring to FIG. 1, reference numeral 10 denotes an image sensing lens; 12, a shutter having a diaphragm function; 14, an image sensing device which converts an optical image into an electrical signal; and 16, an A/D converter which converts an analog signal output from the image sensing device 14 into a digital signal.

Reference numeral 18 denotes a timing generator which supplies a clock signal and control signal respectively to the A/D converter 16 and a D/A converter 26 under the control of a memory controller 22 and system controller 50.

Reference numeral 20 denotes an image processor which executes a predetermined pixel interpolation process and color conversion process for data output from the A/D converter 16 or memory controller 22. The image processor 20 ex cutes a predetermined calculation process using sensed image data. Based on the obtained calculation result, the system controller 50 executes a TTL (through-the-lens) AF (auto focus) process, AE (auto exposure) process, and EF (pre-flash) process with respect to an exposure controller 40 and distance measurement controller 42. Furthermore, the image processor 20 executes a predetermined calculation process using sensed image data, and also executes a TTL AWB (auto white balance) process on the basis of the obtained calculation result.

Reference numeral 22 denotes a memory controller 22, which controls the A/D converter 16, the timing generator 18, the image processor 20, an image display memory 24, the D/A converter 26, a memory 30, and a compression/expansion circuit 32. Data output from the A/D converter 16 is written in the image display memory 24 or memory 30 via the image processor 20 and memory controller 22 or via the memory controller 22 alone.

Reference numeral 24 denotes an image display memory; 26, a D/A converter; and 28, an image display unit, which comprises a TFT LCD or the like. Image data to be displayed written in the image display memory 24 is displayed on the image display unit 28 via the D/A converter 26. An electronic viewfinder function can be realized by sequentially displaying sensed image data using the image display unit 28. The image display unit 28 arbitrarily turns on/off its display in accordance with an instruction from the system controller 50. If the display is turned off, the power consumption of the image sensing apparatus 100 can be greatly reduced.

Reference numeral 30 denotes a memory, which is used to store sensed still images and moving images. The memory 30 has a storage capacity which is large enough to store a predetermined number of still images and a moving image for a predetermined period. In a sequential-shot image sensing mode for sequentially sensing a plurality of still images or a panoramic image sensing mode, large-size image data can be written in the memory 30 at a high speed. The memory 30 can also be used as a work area of the system controller 50.

Reference numeral 32 denotes a compression/expansion circuit, which compresses or expands image data by adaptive discrete cosine transformation (ADCT) or the like. The compression/expansion circuit 32 reads image data stored in the memory 30, executes a compression or expansion process of the read image data, and writes the processed data in the memory 30 again.

Reference numeral 40 denotes an exposure controller, which controls the shutter 12 having the diaphragm function. The exposure controller 40 also has a flash adjusting function in collaboration with a flash 48. Reference numeral 42 denotes a distance measurement controller, which controls focusing of the image sensing lens 10; 44, a zoom controller, which controls zooming of the image sensing lens 10; and 46, a barrier controller, which controls the operation of a barrier 102.

Reference numeral 48 denotes a flash, which also has an AF auxiliary light projection function, and a flash adjusting function. The system controller 50 controls the exposure controller 40 and distance measurement controller 42 by the TTL method on the basis of the result of calculations by the image processor 20 using sensed image data.

Reference numeral 50 denotes a system controller, which controls the overall image sensing apparatus 100. In this embodiment, the system controller 50 serves as a principal building component, and provides functions as an audio recording time setting device, audio recording start reception device, and audio recording device. Reference numeral 52 denotes a memory which stores constants, variables, programs, and the like required to operate the system controller 50.

Reference numeral 54 denotes an indication unit which includes a liquid crystal display device, loudspeaker, and the like, and indicates operation status, messages, and the like using characters, images, sound, and the like in accordance with execution of a program by the system controller 50. For example, the indication unit 54 is provided at one or a plurality of visually recognizable positions around an operation unit, and comprises a combination of an LCD, LEDs, sound generating devices, and the like. Furthermore, some functions of the indication unit 54 are provided within an optical viewfinder 104.

Of the display contents of the indication unit 54, those to be displayed on the LCD or the like include indications of single-/sequential-shot image sensing, a self timer, a compression rate, the number of recordable pixels, the number of recorded images, the number of recordable images, a shutter speed, an f-number (aperture value), exposure compensation, flash illumination, pink-eye effect mitigation, macro image sensing, a buzzer-set state, a timer battery level, a battery level, an error state, information using plural digit numbers, attached/detached state of recording media 200 and 210, operation of a communication I/F, and date and time.

Of the display contents of the indication unit 54, those to be displayed within the optical viewfinder 104 include indications of an in-focus state, camera shake warning, a flash charge state, a shutter speed, an f-number, exposure compensation, and the like.

Reference numeral 56 denotes an electrically erasable and recordable nonvolatile memory such as an EEPROM or the like.

Reference numerals 60, 62, 64, 66, 68, and 70 denote operation members for inputting various operation instructions to the system controller 50. These operation members comprise a combination of one or a plurality of switches, dials, a touch panel, a pointing device by means of line-of-sight detection, a speech recognition device, and the like.

Next, these operation members will be described in more detail below. Reference numeral 60 denotes a model dial switch for switching various function modes such as a power OFF mode, automatic image sensing mode, image sensing mode, panoramic image sensing mode, reproduction mode, multi-image reproduction/deletion mode, PC connection mode, and the like.

Reference numeral 62 denotes a shutter switch SW1, which is turned on upon depressing a shutter button (not shown) to its half-stroke position, and instructs to start operations such as an AF process, AE process, AWB process, EF process, and the like.

Reference numeral 64 denotes a shutter switch SW2, which is turned on upon depressing the shutter button (not shown) to its full-stroke position, and instructs to start a series of processes including an exposure process for writing a signal read out from the image sensing device 14 in the memory 30 as image data via the A/D converter 16 and memory controller 22, a development process using calculations in the image processor 20 and memory controller 22, and a recording process for reading out image data from the memory 30, compressing the readout image data by the compression/expansion circuit 32, and writing the compressed image data in the recording medium 200 or 210.

Reference numeral 66 denotes an image display ON/OFF switch, which can set to turn on/off the image display unit 28. With this function, when an image is to be sensed using the optical viewfinder 104, current supply to the image display unit which comprises the TFT LCD and the like is shut off, thus achieving power savings.

Reference numeral 68 denotes a quick review ON/OFF switch, which is used to set a quick review function of automatically reproducing sensed image data immediately after image sensing. Especially, in this embodiment, the switch 68 has a function of setting a quick review function when the image display unit 28 is OFF.

Reference numeral 70 denotes an operation unit which comprises various buttons and a touch panel. The operation unit 70 includes a menu button, set button, macro button, multi-image reproduction/new page button, flash set button, single-shot/sequential-shot/self-timer select button, forward (+) menu item select button, backward (−) menu item select button, forward (+) reproduction image search button, backward (−) reproduction image search button, image sensing quality select button, exposure correction button, date/time set button, and the like.

Reference numeral 72 denotes a microphone; and 74, a loudspeaker. Reference numeral 80 denotes a power controller which comprises a battery detection circuit, a DC-DC converter, a switch circuit used to select a block to be energized, and the like. The power controller 80 detects the attached/detached state of the battery, battery type, and remaining battery power level, controls the DC-DC converter on the basis of the detection results and an instruction from the system controller 50, and supplies required voltages to respective units including the recording medium for a required period of time.

Reference numerals 82 and 84 denote connectors; and 86, a power source which comprises a primary battery such as an alkaline battery, lithium battery, or the like, a secondary battery such as an NiCd battery, NiMH battery, Li battery, or the like, an AC adapter, and the like.

Reference numerals 90 and 94 denote interfaces with recording media such as a memory card, hard disk, and the like; 92 and 96, connectors for connecting the recording media such as a memory card, hard disk, and the like; and 98, a recording medium attached/detached state detector for detecting whether or not the recording medium 200 or 210 is attached to the connector 92 or 96. Note that this embodiment employs two systems of interfaces and connectors for connecting recording media. However, the number of systems is not limited, and one or a plurality of systems interfaces and connectors for connecting recording media may be employed. Further, interfaces and connectors pursuant to different standards may be combined. As the interfaces and connectors, those which comply with the PCMCIA card standards, CF (Compact Flash®) card standards, and the like may be used. Furthermore, when interfaces and connectors, which comply with the PCMCIA card standards, CF card standards, or the like, are used as the interfaces 90 and 94 and the connectors 92 and 96, image data and management information attached to the image data can be exchanged with other computers and peripheral devices such as a printer and the like by connecting various communication cards such as a LAN card, modem card, USB card, IEEE1394 card, P1284 card, SCSI card, PHS card, and the like.

Reference numeral 102 denotes a barrier which serves as a protection device that covers the image sensing portion including the lens 10 of the image sensing apparatus 100 to protect it from being contaminated or damaged.

Reference numeral 104 d notes an optical viewfinder, which can be used to sense an image without using an electronic viewfinder function provided by the image display unit 28. Within the optical viewfinder 104, some functions of the indication unit 54, e.g., an in-focus state, camera shake warning, flash charge, shutter speed, f-number, exposure correction, and the like are displayed.

Reference numeral 110 denotes a communication unit, which has various communication functions such as RS232C, USB, IEEE1394, P1284, SCSI, modem, LAN, wireless communications, and the like.

Reference numeral 112 denotes a connector or antenna (in case of a wireless communication) for connecting the image sensing apparatus 100 with another apparatus via the communication unit 110.

Reference numeral 200 denotes a recording medium, which comprises a memory card, hard disk, or the like. The recording medium 200 has a recording unit 202 which comprises a semiconductor memory, magnetic disk, or the like, an interface 204 with the image sensing apparatus 100, and a connector 206 for connecting the image sensing apparatus 100.

Reference numeral 210 denotes a recording medium, which comprises a memory card, hard disk, or the like. The recording medium 210 has a recording unit 212 which comprises a semiconductor memory, magnetic disk, or the like, an interface 214 with the image sensing apparatus 100, and a connector 216 for connecting the image sensing apparatus 100.

Figure 2:
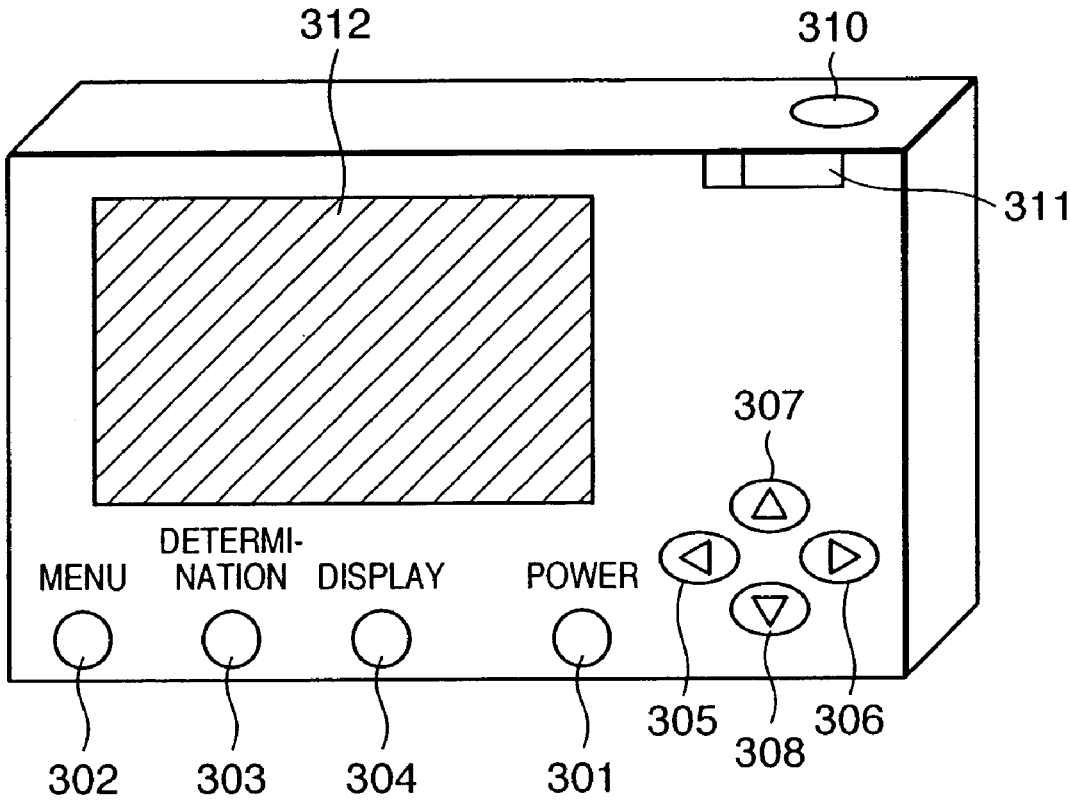
FIG. 2 is a view for explaining operation members of the image sensing apparatus.

FIG. 2 is a view for explaining the operation members of the image sensing apparatus 100. A power button 301 is used to start up and end a digital camera. A menu button 302 is used to display a menu including a change in image sensing mode, a date setup, an image protection/deletion setup, and the like. Also, the menu button 302 is used to quit respective setup modes. A determination button 303 is used to determine a selected item.

A display button 304 is used to switch display/non-display of image sensing information associated with an image. A left button 305 is used to shift an item to be selected to the left or to shift the displayed image. A right button 306 is used to shift an item to be selected to the right or to shift the displayed image. An up button 307 is used to shift an item to be selected upward. A down button 308 is used to shift an item to be selected downward.

A shutter button 310 is used to sense an image in the image sensing mode. A mode select switch 311 is used to switch an image recording mode and reproduction mode. A liquid crystal screen 312 is used when the user wants to sense an image while confirming it, and is also used to confirm the image after it is sensed.

Figure 3:
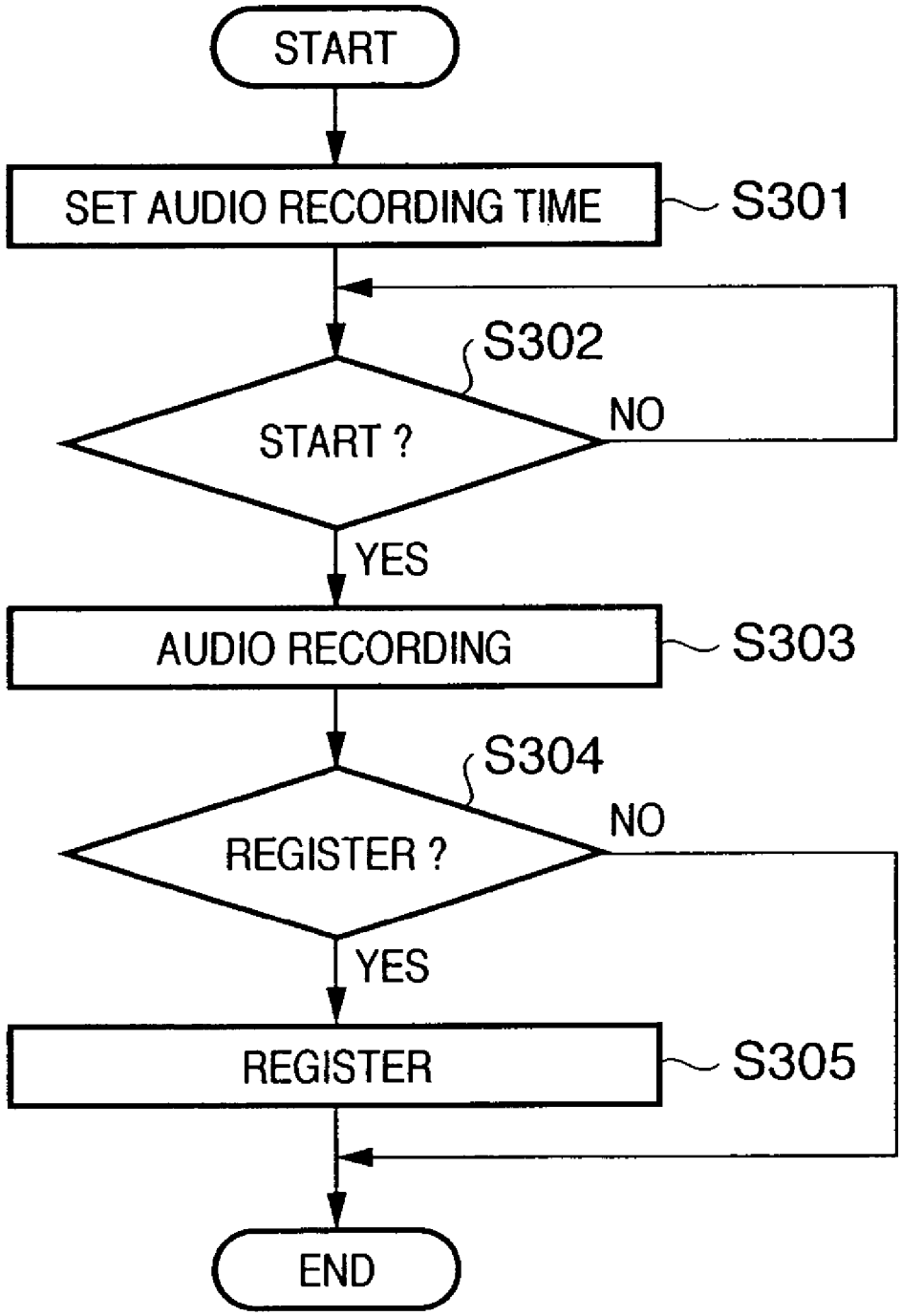
FIG. 3 is a flow chart showing the flow of an audio processing operation.

FIG. 3 is a flow chart showing the flow of an audio processing operation of this embodiment. Upon recording audio data, an audio recording time of audio data to be recorded is set (step S301). This audio recording time is a fixed value, which does not change independently of the free space of a recording medium, and is specified by a target sound since an area on a RAM is used. As will be described later, a startup sound, operation sound, shutter sound, and self-timer sound are set as purposes of audio data to be recorded, and their audio recording times are determined in advance. Hence, the audio recording time is set by selecting a desired purpose.

After the audio recording time is set, the user starts audio recording at an arbitrary timing (step S302).

When audio recording is started by user's intention, audio data is recorded for the time set in step S301 (step S303). During this interval, other operations such as an audio recording stop operation and the like are inhibited, and audio recording is executed until the set audio recording time elapses.

After that, the user determines if the recorded audio data is to be registered (step S304). If the recorded audio data is to be registered, it is registered as one of effect sounds in the digital camera (step S305).

Figure 4:
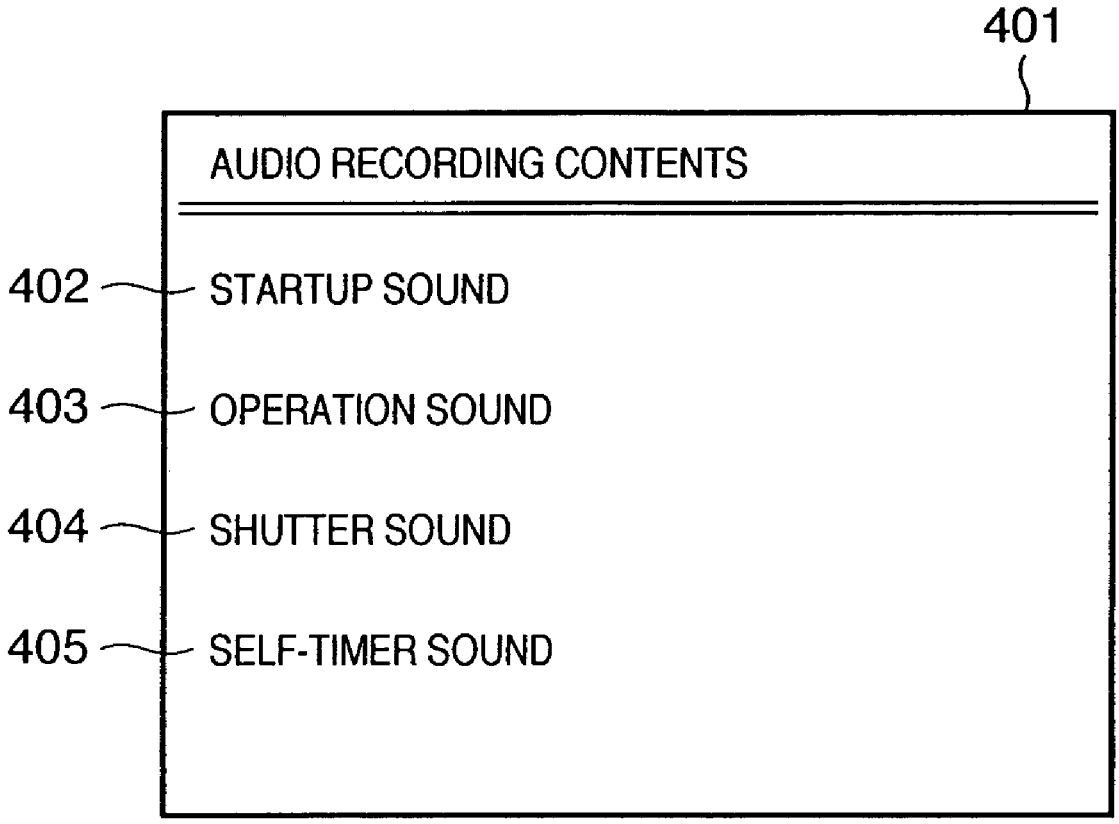
FIG. 4 shows a screen display example upon registering audio data.

FIG. 4 shows a display example on a liquid crystal screen 401 (liquid crystal screen 312 in FIG. 2) upon registering audio data. As items for recording audio data (purposes of audio data), a startup sound 402, operation sound 403, shutter sound 404, and self-timer sound 405 are set. The user shifts an item to that to be registered using the up and down buttons 307 and 308, and then presses the determination button 303 to display an audio recording screen.

Figure 5:
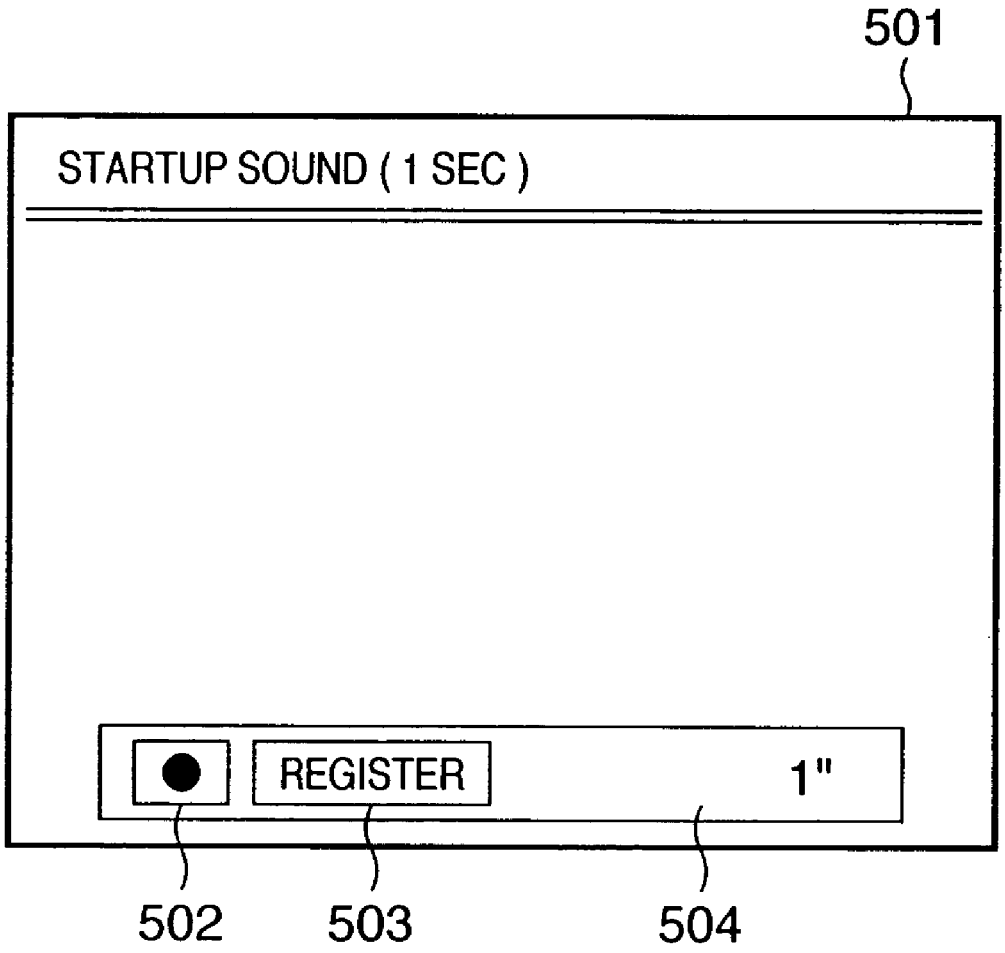
FIG. 5 shows a screen display example upon recording a startup sound.

FIG. 5 shows a display example on a liquid crystal screen 501 (liquid crystal screen 312 in FIG. 2) upon recording a startup sound. A panel displayed on the lower portion of the screen displays an audio recording button 502, registration button 503, and counter 504 that shows an audio recording time. The user moves a focus of a button using the left and right buttons 305 and 306, and then presses the determination button 303 to execute a desired operation. Before audio recording, the registration button is unselectable.

Figure 6:
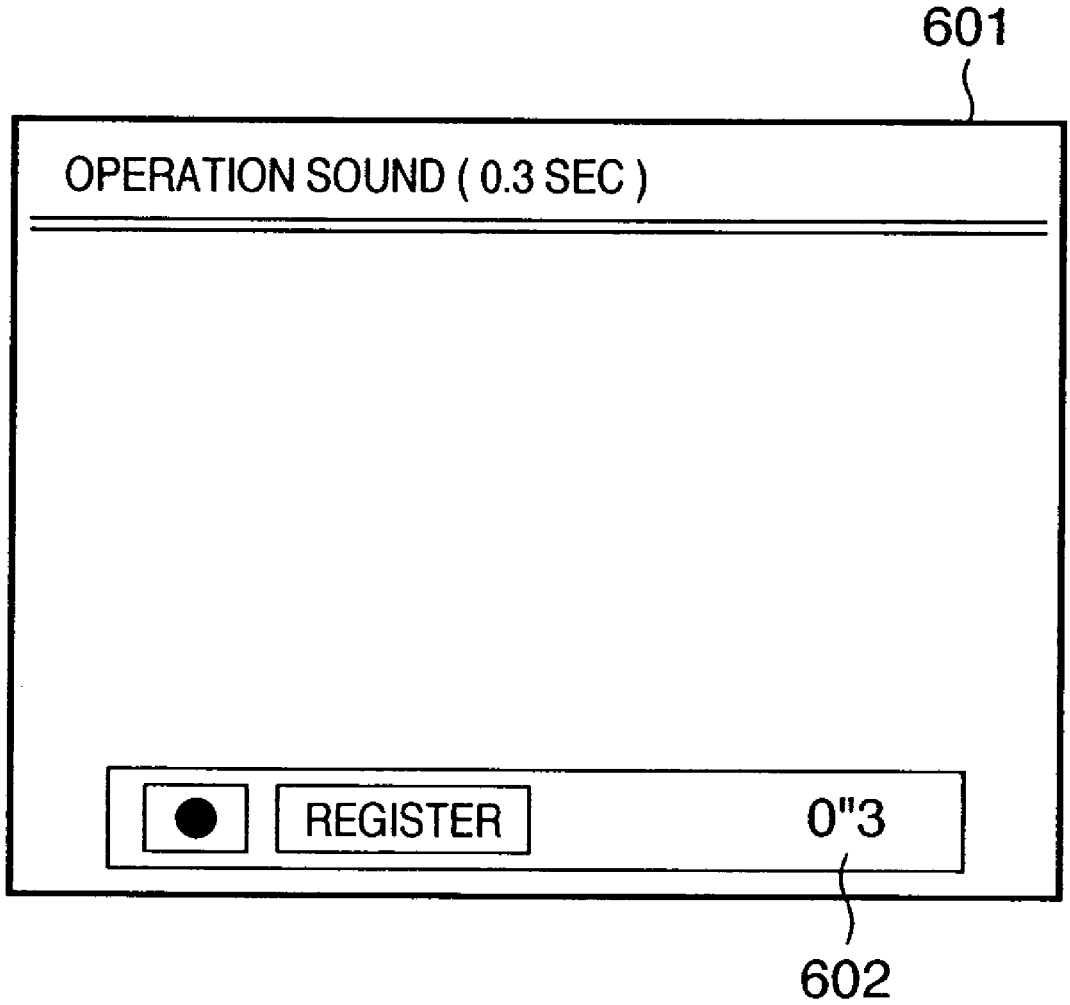
FIG. 6 shows a screen display example upon recording an operation sound.

FIG. 6 shows a display example on a liquid crystal screen 601 (liquid crystal screen 312 in FIG. 2) upon recording an operation sound. In case of the operation sound, the audio recording time is set to be as short as 0.3 sec compared to the startup sound described using FIG. 5, and that audio recording time is indicated by a counter 602.

On the audio recording screens shown in FIGS. 5 and 6, only audio recording start and registration functions are provided. Also, an audio reproduction function, volume adjustment function, and the like may be provided on this screen. In this case, the user can confirm the recorded audio contents by reproducing the recorded data, and can determine if that data is to be registered.

Another Embodiment

The scope of the present invention includes a case wherein the functions of the embodiments are implemented by supplying a program code of software that implements the functions of the embodiments to a computer (or a CPU or MPU) in a system or apparatus, which is connected to various devices to make these devices implement the functions of the aforementioned embodiments, and making the computer of the system or apparatus control the devices in accordance with the stored program.

In this case, the program code itself of software implements the functions of the embodiments, and the program code itself constitutes the present invention. As a transmission medium of the program code, communication media (a wired line such as an optical fiber or the like, wireless line, and the like) in a computer network (LAN, WAN such as the Internet or the like, wireless communication network, or the like) system that supplies program information by making it propagate as a carrier wave can be used.

Furthermore, a device used to supply the program code to the computer (e.g., a recording medium that stores the program code) constitutes the present invention. As the recording medium for storing such program code, for example, a flexible disk, hard disk, optical disk, magnetooptical disk, CD-ROM, magnetic tape, nonvolatile memory card, ROM, and the like may be used.

The program code is included in the embodiments of the present invention not only when the functions of the above embodiments are implemented by executing the supplied program code by the computer, but also when the functions of the embodiments are implemented by collaboration of the program and an OS (operating system) or another application software running on the computer.

Furthermore, the present invention includes a case wherein the functions of the above embodiments are implemented by some or all of actual processing operations executed by a CPU or the like arranged in a function extension board or a function extension unit, which is inserted in or connected to the computer, after the supplied program code is written in a memory of the extension board or unit.

Note that the shapes and structures of respective units described in the above embodiment are merely examples upon practicing the present invention, and the technical scope of the present invention must not be limitedly interpreted by them. That is, various modifications of the present invention can be made without departing from the spirit and scope thereof. For example, the recording media 200 and 210 are not limited to memory cards such as a PCMCIA card, compact flash® card, and the like, hard disk, and so forth, but may comprise a micro DAT, a magnetooptical disk, optical disk such as a CD-R, CD-RW, or the like, a phase change optical disk such as a DVD or the like. Also, the recording media 200 and 210 may comprise hybrid media that integrate a memory card and hard disk. The recording media 200 and 210 are separated from the image sensing apparatus 100, and are arbitrarily connectable. However, one or both the recording media 200 and 210 may be fixed to the image sensing apparatus 100.

As described above, according to the above embodiment, after audio recording is started, audio recording is executed until the set audio recording time elapses, and a stop operation and the like are inhibited during this interval. Hence, even when audio data is to be recorded for a very short period of time, e.g., when audio data is recorded as an operation sound or startup sound of an image sensing apparatus such as a digital camera or the like, the audio data can be recorded by a simple operation.

As many apparently widely different embodiments of the present invention can be made without departing from the spirit and scope thereof, it is to be understood that the invention is not limited to the specific embodiments thereof except as defined in the claims.

What is claimed is:

1. An audio processor for processing audio data of an effect sound in an image sensing apparatus comprising:

an audio recording time setting device adapted to set an audio recording time period of the effect sound in accordance with a desired purpose of the effect sound which corresponds to an operation status of an image sensing apparatus, wherein the audio recording time period is a time period between start of recording the effect sound and end of recording the effect sound and wherein the set audio recording time period is selected from a plurality of time periods by selecting the desired purpose of the effect sound from a plurality of desired purposes by a user, said plurality of time periods being prepared in advance in association with the desired purposes;

an audio recording start reception device adapted to receive an audio recording start instruction;

an audio recording device adapted to record audio until the set audio recording time period elapses, upon reception of the audio recording start instruction; and a registration device adapted to register the audio data recorded by said audio recording device according to the desired purpose of the effect sound.

2. The processor according to claim 1, further comprising a reproduction device adapted to reproduce recorded audio data.

3. An audio processing method for processing audio data of an effect sound in an image sensing apparatus comprising:

setting an audio recording time period of the effect sound in accordance with a desired purpose of the effect sound which corresponds to an operation status of an image sensing apparatus, wherein the audio recording time period is a time period between start of recording the effect sound and end of recording the effect sound and wherein the set audio recording time period is selected from a plurality of time periods, by selecting the desired purpose of the effect sound from a plurality of desired purposes by a user, said plurality of time periods being prepared in advance in association with the desired purposes;

receiving an audio recording start instruction;

recording audio until the set audio recording time period elapses, upon reception of the audio recording start instruction; and registering the audio data recorded at said recording step according to the desired purpose of the effect sound.

4. A computer program encoded on a non-transitory computer readable medium for processing audio data of an effect sound in an image sensing apparatus, the program comprising the steps of:

setting an audio recording time period of the effect sound in accordance with a desired purpose of the effect sound which corresponds to an operation status of an image sensing apparatus, wherein the audio recording time period is a time period between start of recording the effect sound and end of recording the effect sound and wherein the set audio recording time period is selected from a plurality of time periods, by selecting the desired purpose of the effect sound from a plurality of desired purposes by a user, said plurality of time periods being prepared in advance in association with the desired purposes;

receiving an audio recording start instruction;

recording audio until the set audio recording time period elapses, upon reception of the audio recording start instruction; and registering audio data recorded at the recording step according to the desired purpose of the effect sound.

5. A non-transitory computer readable storage medium storing a computer program of claim 4.

6. An image sensing apparatus capable of recording an effect sound comprising:

an audio recording time setting device adapted to set an audio recording time period of the effect sound in accordance with a desired purpose of the effect sound which corresponds to an operation status of an image sensing apparatus;

an audio recording start reception device adapted to receive an audio recording start instruction;

an audio recording device adapted to record audio until the set audio recording time period elapses, upon reception of the audio recording start instruction;

a registration device adapted to register the audio data recorded by said audio recording device according to the desired purpose of the effect sound;

a reproduction device adapted to reproduce the recorded audio data; and a display unit adapted to display the audio recording time period set by said audio recording time setting device, wherein the audio recording time period is a time period between start of recording the effect sound and end of recording the effect sound, wherein the set audio recording time period is selected from a plurality of time periods by selecting the desired purpose of the effect sound from a plurality of desired purposes by a user, said plurality of time periods being prepared in advance in association with the desired purposes, and wherein the effect sound includes at least one of a startup sound, a shutter sound, and a self-timer sound.

* * * * *